United States Patent [19]

Thomas

[11] 4,370,512

[45] Jan. 25, 1983

[54] SHIELDING DEVICE FOR ELECTRICAL INDUCTIVE STRUCTURE

[75] Inventor: Michael W. Thomas, Marshall, Pa.

[73] Assignee: Westinghouse Electric Corp., Pittsburgh, Pa.

[21] Appl. No.: 237,016

[22] Filed: Feb. 23, 1981

[51] Int. Cl.[3] ..... H01F 27/34; H01F 27/04

[52] U.S. Cl. ..... 174/18; 174/35 CE

[58] Field of Search ..... 174/15 BH, 16 BH, 18, 174/35 CE; 336/58, 84 R, 84 M, 90, 94; 200/150 J

[56] References Cited

FOREIGN PATENT DOCUMENTS

| | | | |
|---|---|---|---|
| 592759 | 2/1960 | Canada | 174/35 CE |
| 675877 | 11/1929 | France | 174/35 CE |
| 54-4318 | 1/1979 | Japan | 174/35 CE |
| 164020 | 11/1933 | Switzerland | 200/150 J |
| 166929 | 4/1934 | Switzerland | 200/150 J |
| 166930 | 4/1934 | Switzerland | 200/150 J |
| 265966 | 9/1927 | United Kingdom | 174/35 CE |
| 416564 | of 1934 | United Kingdom | 174/35 CE |

*Primary Examiner*—Laramie E. Askin

*Attorney, Agent, or Firm*—L. P. Johns

[57] ABSTRACT

Electrical inductive apparatus for minimizing power losses in heating of a tank of an electrical inductive structure due to a magnetic field characterized by a tank having a metal wall including openings therein, electrical inductive apparatus within the tank and having terminals thereon, a bushing extending through each opening, conductor means extending through each bushing and connected to the terminals, an electrically conductive shielding member within the tank and disposed between the openings, an electrically conductive member externally of the tank, the shielding member being electrically connected to the electrically conductive member through the openings, whereby the tank is shielded from magnetic fields generated by load currents flowing through the conductor means to minimize power losses and heating of the tank wall.

4 Claims, 3 Drawing Figures

SHIELDING DEVICE FOR ELECTRICAL INDUCTIVE STRUCTURE

BACKGROUND OF THE INVENTION

1. Field of the Invention

This invention relates in general to electrical inductive apparatus, such as transformers and electrical reactors, and more specifically to the reduction of losses incurred by magnetic fields generated by load currents flowing through bushings.

2. Description of the Prior Art

Electrical inductive apparatus, such as large generator step-up transformers, have high current bushings mounted on the container or tank wall. Load current passing through such bushings generates a magnetic field which sets up eddy currents in the container of wall. These currents cause power loss and may result in excessive heating. Although special steel has been used in the area of the low voltage bushings to prevent overheating, such steel is expensive and difficult to machine. Accordingly, better means for reducing power losses and heating from the low voltage bushings is desirable.

SUMMARY OF THE INVENTION

It has been found in accordance with this invention that power losses in heating of a tank of an electrical inductive structure due to a magnetic field may be minimized by a structure comprising a tank having a metal wall including openings therein, electrical inductive apparatus within the tank and having terminals thereon, a bushing extending through each opening, conductor means extending through each bushing and connected to the terminals, a shielding member within the tank and disposed between the openings, an electrically conductive member externally of the tank, the shielding member being electrically connected to the electrically conductive member through the openings, whereby the tank is shielded from magnetic fields generated by load currents flowing through the conductor means to minimize power losses and heating of the tank wall.

The advantage of the structure of this invention is that a shield for tanks of transformers or reactors in the vicinity of high current bushings from magnetic fields generated by load currents flowing in high current bushings eliminates losses and heating of the tank wall.

DESCRIPTION OF THE PREFERRED EMBODIMENTS

Figure 1:
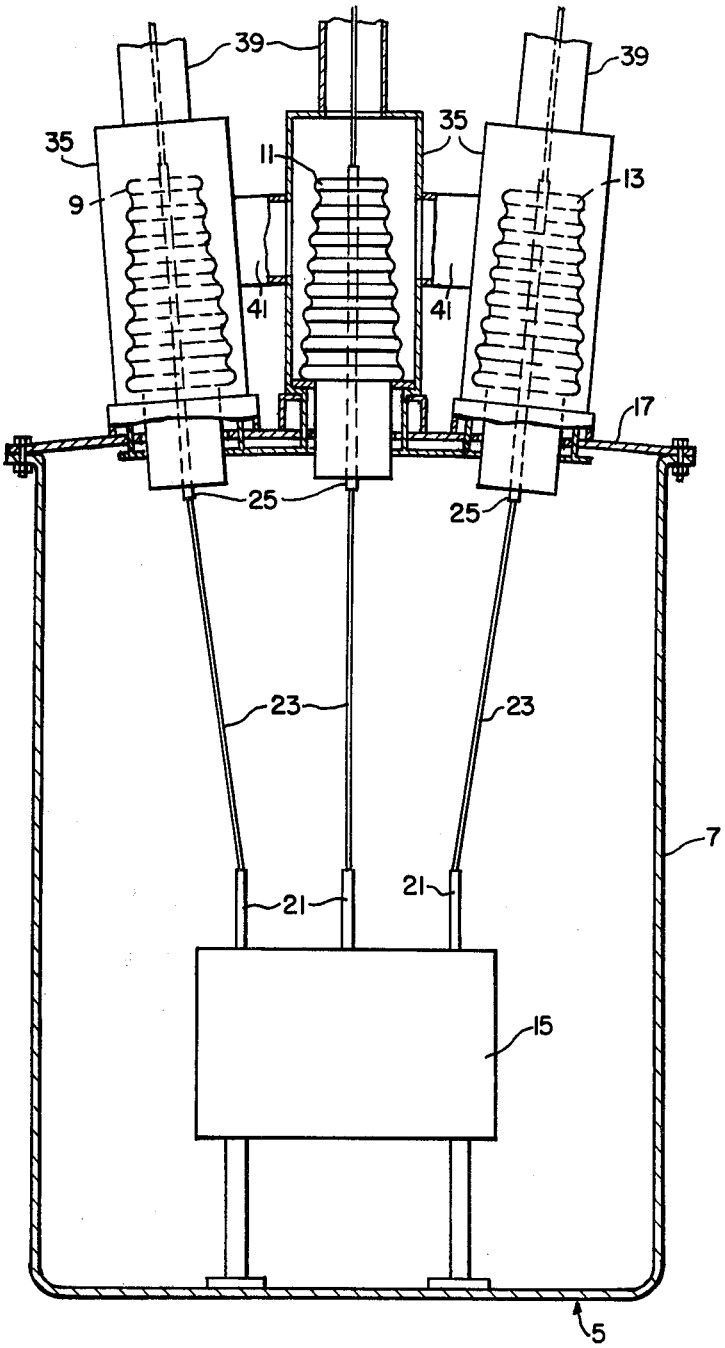
FIG. 1 is a schematic view of an electrical inductive structure in accordance with this invention.
Figure 2:
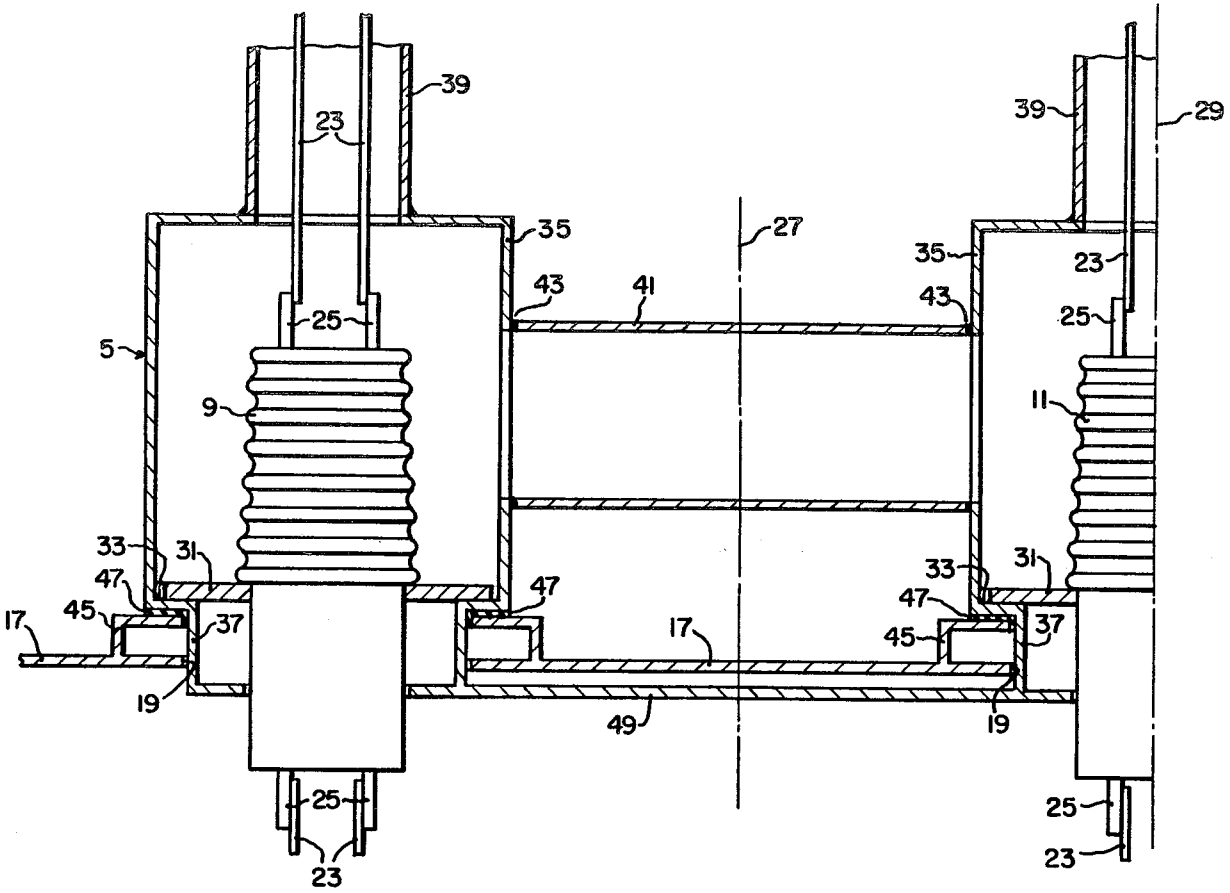
FIG. 2 is an enlarged fragmentary sectional view symmetrical about one of two center lines.

In FIG. 1, an electrical inductive structure is generally indicated at 5 and it comprises a metal tank 7, bushings 9, 11, 13 and an electrical inductive apparatus 15. The tank 7 is a container adapted to be filled with a dielectric coolant fluid, such as oil, in which the apparatus 15 is immersed. The tank also comprises a metal cover 17 having openings 19 (FIG. 2) through which the bushings extend. The apparatus 15 may be either a reactor or transformer having similar terminals 21 to which conductors 23 are connected. The conductors 23 extend to conductors 25 which extend through the bushings 9, 11, 13. Where more than one conductor 25 is disposed in each bushing, a corresponding number of conductors 23 are likewise provided or a corresponding number of terminals 21.

Figure 3:
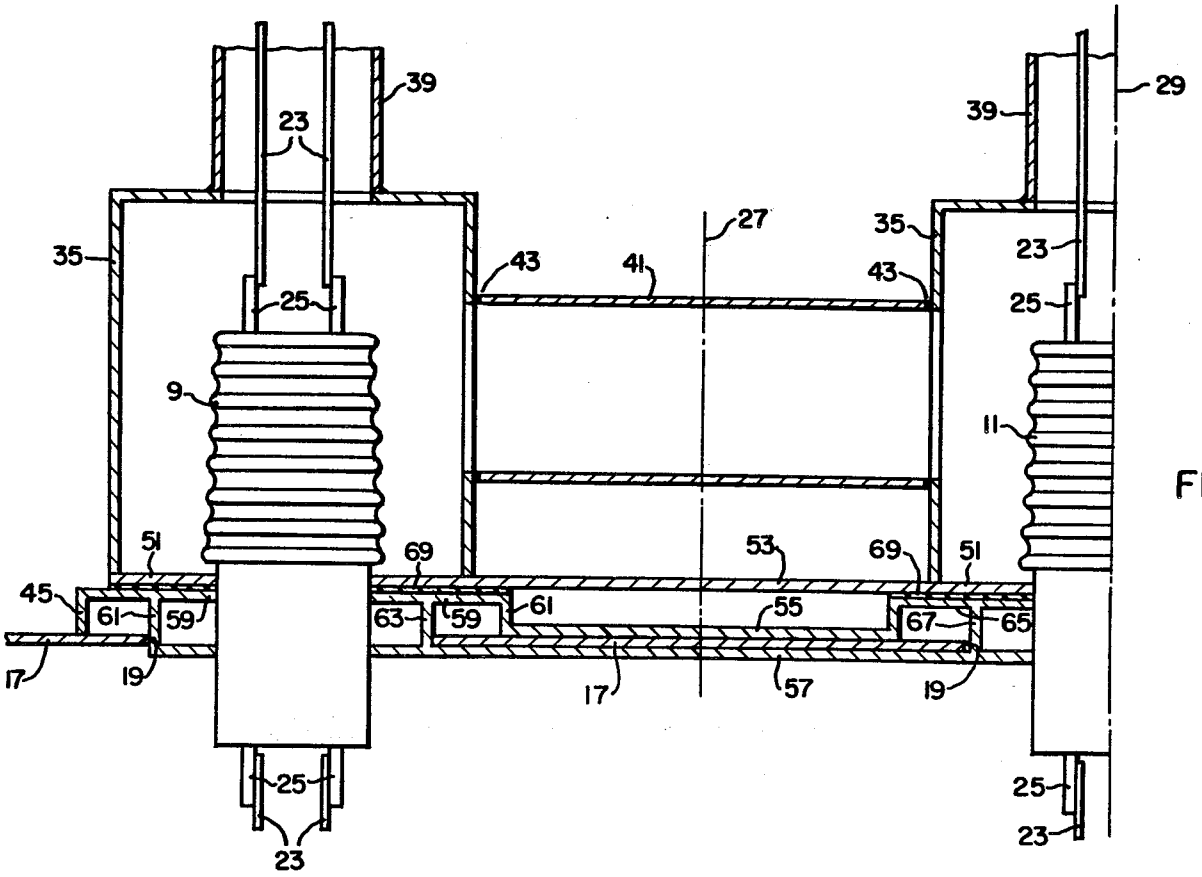
FIG. 3 is an enlarged fragmentary sectional view of another embodiment of the invention, symmetrical about one of two center lines.

The teachings of this invention are pertinent to apparatus, such as transformers or reactors, which are either one-phase or three-phase. For one-phase operation, the structure shown in FIGS. 2 and 3 should be regarded as symmetrical about a center line 27. For three-phase operation, the structure should be regarded as being symmetrical about a center line 29. Accordingly, it is understood that in FIGS. 2 and 3, the bushings 13 may or may not be involved depending upon what phase of operation is included. Suffice it to say, the device of the invention pertains to either phase of operation.

The bushings 9, 11 (FIG. 2) extend through similar openings 19 in the cover 17. Each bushing 9, 11 is supported on a mounting plate 31 which is, in turn, supported upon a surface 33 of a bus duct housing 35 having a necked portion 37 extending through the opening 19 and into the interior of the tank 7. The housing 35 may also include a tubular portion 39 extending from the upper surface of the housing. Thus, each bus duct housing 35 is disposed about a corresponding bushing. An air return conduit 41 provides for circulation of air between the interiors of adjacent bus duct housings 35 with insulated joints 43 at either end of the conduit 41.

Each bus duct housing 35 is supported on a mounting member 45 on the cover 17 with insulated joints 47 between the corresponding members 35, 45. An insulated joint, such as an air gap between the necked portion 37 and the opening 19, is provided.

In accordance with this invention, an electrically conductive member 49 extends between the adjacent bus duct housings 35 which member serves as a shielding for the metal cover 17 as well as a shorting member between the bus duct housings 35. The conductive member 49 is disposed within the tank chamber and is spaced from the tank cover 17. Accordingly, the bus duct housing may connect to a low voltage isolated phase bus duct. A novel feature of the housing is that the conductive member 49 which electrically connects the isolated bus housings is inside the transformer wall, rather than outside the wall as in prior art bus duct housing. Moreover, isolation and magnetic field shielding is provided by the bus duct through the transformer tank cover 17. Furthermore, by its location within the tank cover, the conductive member 49 of the bus duct housing may be subjected to the cooling effects of a dielectric coolant fluid within the tank.

In another embodiment of the invention (FIG. 3) similar numerals refer to similar parts for the purpose of simplifying the description. The embodiment of FIG. 3 differs from that of FIG. 2 in that the bus duct housings 35 include bottom walls 51 with an interconnecting condutive member 53 therebetween and outside of the tank cover 17. Moreover, this embodiment of the invention includes conductive or shielding members 55, 57 on opposite sides of and preferably in contact with the surfaces of the cover 17. Corresponding ends of the members 55, 57 are integral with a hollow annular portion 59 which surrounds a lower portion of the bushing 9. More particularly, the annular portion 59 includes walls 61, 63 which extend through openings 19 of the cover 17 and preferably in contact with the cover wall. Likewise, corresponding opposite ends of the members 55, 57 comprise an integral hollow annular portion 65 having corresponding walls 67 (one of which is shown). Insulated joints 69 are provided between inner portions 55, 65 and corresponding bus duct housings 35.

The cover 17 of the tank is provided with a shield comprising parts 55, 57, 59, 65 within and external of the area of the bushings 35, whereby a complete circuit of a shield is provided to permit current to flow in the shield from phase-to-phase in a three-phase transformer or a terminal to terminal in a single-phase transformer. Such current circulation prevents magnetic fields from entering the tank walls and generating eddy currents in the tank. Losses and heating of the shielding are less than those generated in the tank wall without the shielding due to the high conductivity of the shielding material. The shielding members 55, 57, 59, 65 are thus electrically interconnected to electrically conductive members 63, 67 through the openings 19. Thus, the external electrically conductive member 55 functions as a second shielding member that extends through the openings 19 and is adjacent to the outer surface of the cover of the tank. In other words, the conductive or shielding members 55, 57 shield the tank cover from magnetic fields generated by the load currents flowing through the conductor means 25 and comprise conductor walls surrounding the portions of the bushing but which are electrically insulated from the bus duct housings 35 and conductive or shielding member 53.

Accordingly, the device of this invention essentially provides for the elimination of losses from heating generated in a transformer tank near the bushings whereby transformer losses are reduced and expensive special steels are no longer necessary in the high current bushing areas.

What is claimed is:

1. An electrical inductive structure for eliminating power losses, comprising:

(a) a tank having a metal wall including openings therein;

(b) electrical inductive apparatus within the tank and having terminals thereon;

(c) a bushing extending through each opening;

(d) conductor means extending through each bushing and connected to the terminals;

(e) an electrically conductive shielding member within the tank and disposed between the openings and having portions extending through the openings;

(f) electrically conductive means externally of the tank and comprising a bus duct housing disposed about each bushing and electrically connected to the portions of the shielding member; and (g) an air return conduit between the bus duct housings and electrically insulated from the bus duct housings and being spaced from the tank wall.

2. The structure of claim 1 in which each bus duct housing is electrically insulated from the tank wall.

3. The structure of claim 1 in which a dielectric cooling fluid occupies the tank and in which the electrically conductive shielding member within the tank is contacted by the cooling fluid.

4. An electrical inductive structure for eliminating power losses, comprising:

(a) a tank having a metal wall including openings therein;

(b) electrical inductive apparatus within the tank and having terminals thereon;

(c) a bushing extending through each opening;

(d) conductor means extending through each bushing and connected to the terminals;

(e) an electrically conductive shielding member within the tank and disposed between the openings and having portions extending through the openings;

(f) electrically conductive means externally of the tank and electrically connected to the portions of the shielding member;

(g) a bus duct housing disposed about each bushing and electrically insulated from the tank and electrically conductive means; and (h) an air return conduit between the bus duct housings and electrically insulated from the bus duct housings and being spaced from the tank wall.

* * * * *